US009205021B2

(12) United States Patent
Malhi

(10) Patent No.: US 9,205,021 B2
(45) Date of Patent: Dec. 8, 2015

(54) COMPRESSION SYSTEM WITH VENT COOLING FEATURE

(75) Inventor: Arnaz S. Malhi, Watertown, MA (US)

(73) Assignee: Covidien LP, Mansfield, MA (US)

( * ) Notice: Subject to any disclaimer, the term of this patent is extended or adjusted under 35 U.S.C. 154(b) by 724 days.

(21) Appl. No.: 13/525,412

(22) Filed: Jun. 18, 2012

(65) Prior Publication Data

US 2013/0338552 A1 Dec. 19, 2013

(51) Int. Cl.

| | |
|---|---|
| ***A61H 7/00*** | (2006.01) |
| ***A61H 19/00*** | (2006.01) |
| ***A61H 23/04*** | (2006.01) |

(52) U.S. Cl.

CPC ..... *A61H 23/04* (2013.01); *A61H 2201/02* (2013.01)

(58) Field of Classification Search

CPC ..... A61H 9/00; A61H 9/0007; A61H 9/005; A61H 9/0078; A61H 9/0092; A61H 23/04
USPC ..... 601/148–152
See application file for complete search history.

(56) References Cited

U.S. PATENT DOCUMENTS

| | | | |
|---|---|---|---|
| 908,959 | A | 1/1909 | Cooke |
| 910,689 | A | 1/1909 | Kelly et al. |
| 1,510,482 | A | 10/1924 | Kramer |
| 1,608,239 | A | 11/1926 | Rosett |
| 2,199,408 | A | 5/1940 | Liberte |
| 2,250,617 | A | 7/1941 | Argentin |
| 2,489,388 | A | 11/1949 | Rubin |
| 2,533,504 | A | 12/1950 | Poor |
| 2,638,915 | A | 5/1953 | Mitchell |
| 2,676,587 | A | 4/1954 | Corcoran |
| 2,694,395 | A | 11/1954 | Brown |
| 2,853,998 | A | 9/1958 | Emerson |
| 2,880,721 | A | 4/1959 | Corcoran |
| 2,896,612 | A | 7/1959 | Bates et al. |
| 2,998,817 | A | 9/1961 | Armstrong |
| 3,164,152 | A | 1/1965 | Nicoll |
| 3,245,405 | A | 4/1966 | Gardner |
| 3,288,132 | A | 11/1966 | Meredith |
| 3,351,055 | A | 11/1967 | Gottfried |

(Continued)

FOREIGN PATENT DOCUMENTS

| | | | |
|---|---|---|---|
| CA | 2582678 | A1 | 4/2006 |
| CN | 1009155 | A | 1/1987 |

(Continued)

OTHER PUBLICATIONS

Office Action dated Jul. 29, 2014 in related Korean Patent Application serial No. 10-2013-0068775, 4 pages.

(Continued)

*Primary Examiner* — Justine Yu
*Assistant Examiner* — Kathrynn Reilly
(74) *Attorney, Agent, or Firm* — John Paul Mello, Esq.

(57) ABSTRACT

A compression device for providing compression treatment to a limb of a wearer includes a compression garment positionable on the limb of the wearer. The garment includes an inflatable bladder for providing compression treatment to the limb. A controller is adapted for fluidly connecting to the inflatable bladder and configured for inflating and deflating the bladder during a compression cycle. The controller has an exhaust port positioned to direct exhaust fluid through the bladder so exhaust fluid flows over the limb of the wearer to cool the limb.

14 Claims, 11 Drawing Sheets

(56) References Cited

U.S. PATENT DOCUMENTS 3,454,010 A 7/1969 Lilligren et al.
3,469,769 A 9/1969 Guenther
3,473,527 A 10/1969 Spiro
3,504,675 A 4/1970 Bishop, Jr.
3,561,435 A 2/1971 Nicholson
3,568,227 A 3/1971 Dunham
3,606,880 A 9/1971 Ogle, Jr.
3,638,334 A 2/1972 Malikowski
3,701,173 A 10/1972 Whitney
3,728,875 A 4/1973 Hartigan et al.
3,760,795 A 9/1973 Adelhed
3,770,040 A 11/1973 De Cicco
3,771,519 A 11/1973 Haake
3,786,805 A 1/1974 Tourin
3,824,992 A 7/1974 Nicholson et al.
3,826,249 A 7/1974 Lee et al.
3,862,629 A 1/1975 Rotta
3,868,952 A 3/1975 Hatton
3,877,426 A 4/1975 Nirschl
3,878,839 A 4/1975 Norton et al.
3,899,210 A 8/1975 Samhammer et al.
3,901,221 A 8/1975 Nicholson et al.
3,906,937 A 9/1975 Aronson
3,920,006 A 11/1975 Lapidus
D239,981 S 5/1976 Arluck et al.
3,955,565 A 5/1976 Johnson, Jr.
4,013,069 A 3/1977 Hasty
4,029,087 A 6/1977 Dye et al.
4,030,488 A 6/1977 Hasty
4,054,129 A 10/1977 Byars et al.
4,066,084 A 1/1978 Tillander
4,076,022 A 2/1978 Walker
4,091,804 A 5/1978 Hasty
4,116,236 A 9/1978 Albert
4,146,021 A 3/1979 Brosseau et al.
4,149,529 A 4/1979 Copeland et al.
4,149,541 A 4/1979 Gammons et al.
4,153,050 A 5/1979 Bishop et al.
4,156,425 A 5/1979 Arkans
4,197,837 A * 4/1980 Tringali et al. ..... 601/150
4,198,961 A 4/1980 Arkans
4,201,203 A 5/1980 Applegate
4,202,312 A 5/1980 Mori et al.
4,202,325 A 5/1980 Villari et al.
4,206,751 A 6/1980 Schneider
4,207,875 A 6/1980 Arkans
4,207,876 A 6/1980 Annis
4,219,892 A 9/1980 Rigdon
4,253,449 A 3/1981 Arkans et al.
D259,058 S 4/1981 Marshall
4,267,611 A 5/1981 Agulnick
4,270,527 A 6/1981 Peters et al.
4,280,485 A 7/1981 Arkans
4,294,238 A 10/1981 Woodford
4,294,240 A 10/1981 Thill
4,300,245 A 11/1981 Saunders
4,308,862 A 1/1982 Kalmar
4,311,135 A * 1/1982 Brueckner et al. ..... 601/152
4,320,746 A 3/1982 Arkans et al.
4,343,302 A 8/1982 Dillon
4,352,253 A 10/1982 Oswalt
4,355,632 A 10/1982 Sandman
4,363,125 A 12/1982 Brewer et al.
4,372,297 A 2/1983 Perlin
4,375,217 A 3/1983 Arkans et al.
4,379,217 A 4/1983 Youmans
4,402,312 A 9/1983 Villari et al.
4,408,599 A 10/1983 Mummert
4,417,587 A 11/1983 Ichinomiya et al.
4,425,912 A 1/1984 Harper
4,437,269 A 3/1984 Shaw
4,442,834 A 4/1984 Tucker et al.
4,445,505 A 5/1984 Labour et al.
4,453,538 A 6/1984 Whitney
4,522,197 A 6/1985 Hasegawa
4,531,516 A 7/1985 Poole et al.
4,547,906 A 10/1985 Nishida et al.
4,547,919 A 10/1985 Wang
4,552,821 A 11/1985 Gibbard et al.
4,580,816 A 4/1986 Campbell et al.
4,583,255 A 4/1986 Mogaki et al.
4,593,692 A 6/1986 Flowers
4,597,384 A 7/1986 Whitney
4,614,180 A 9/1986 Gardner et al.
4,624,244 A 11/1986 Taheri
4,650,452 A 3/1987 Jensen
4,657,003 A 4/1987 Wirtz
4,682,588 A 7/1987 Curlee
4,696,289 A 9/1987 Gardner et al.
4,699,424 A 10/1987 Andres et al.
4,702,232 A 10/1987 Gardner et al.
4,703,750 A 11/1987 Sebastian et al.
4,706,658 A 11/1987 Cronin
4,722,332 A 2/1988 Saggers
4,730,606 A 3/1988 Leininger
4,753,649 A 6/1988 Pazdernik
4,762,121 A 8/1988 Shienfeld
4,773,397 A 9/1988 Wright et al.
4,805,620 A 2/1989 Meistrell
4,809,684 A 3/1989 Gardner et al.
4,827,912 A 5/1989 Carrington et al.
4,832,010 A 5/1989 Lerman
RE32,939 E 6/1989 Gardner et al.
RE32,940 E 6/1989 Gardner et al.
4,836,194 A 6/1989 Sebastian et al.
4,836,691 A 6/1989 Suzuki et al.
D302,301 S 7/1989 Robinette-Lehman
4,846,189 A 7/1989 Sun
4,869,265 A 9/1989 McEwen
4,872,448 A 10/1989 Johnson, Jr.
4,876,788 A 10/1989 Steer et al.
4,883,073 A 11/1989 Aziz
4,886,053 A 12/1989 Neal
4,898,160 A 2/1990 Brownlee
4,913,136 A 4/1990 Chong et al.
4,938,207 A 7/1990 Vargo
4,938,208 A 7/1990 Dye
4,938,226 A 7/1990 Danielsson et al.
4,945,571 A 8/1990 Calvert
4,947,834 A 8/1990 Kartheus et al.
4,957,105 A 9/1990 Kurth
4,960,115 A 10/1990 Ranciato
4,964,402 A 10/1990 Grim et al.
4,979,953 A 12/1990 Spence
4,985,024 A 1/1991 Sipinen
4,989,273 A 2/1991 Cromartie
4,997,452 A 3/1991 Kovach et al.
5,007,411 A 4/1991 Dye
5,014,681 A 5/1991 Neeman et al.
5,022,387 A 6/1991 Hasty
5,031,604 A 7/1991 Dye
5,048,536 A 9/1991 McEwen
5,052,377 A 10/1991 Frajdenrajch
5,062,414 A 11/1991 Grim
5,069,219 A 12/1991 Knoblich
5,071,415 A 12/1991 Takemoto
5,080,951 A 1/1992 Guthrie
5,082,284 A 1/1992 Reed
5,109,832 A 5/1992 Proctor et al.
5,117,812 A 6/1992 McWhorter
5,120,300 A 6/1992 Shaw
5,135,473 A 8/1992 Epler et al.
5,139,475 A 8/1992 Robicsek
5,139,476 A 8/1992 Peters
5,139,479 A 8/1992 Peters
5,146,932 A 9/1992 McCabe
5,156,629 A 10/1992 Shane et al.
5,158,541 A 10/1992 McCurley
5,168,576 A 12/1992 Krent et al.
5,172,689 A 12/1992 Wright
D332,495 S 1/1993 Lake
5,179,941 A 1/1993 Siemssen et al.
5,181,522 A 1/1993 McEwen
5,186,163 A 2/1993 Dye

(56) References Cited

U.S. PATENT DOCUMENTS

| | | | |
|---|---|---|---|
| 5,193,549 | A | 3/1993 | Bellin et al. |
| 5,211,162 | A | 5/1993 | Gillen, Jr. et al. |
| 5,226,245 | A | 7/1993 | Lamont |
| 5,228,478 | A | 7/1993 | Kleisle |
| 5,230,335 | A | 7/1993 | Johnson, Jr. et al. |
| 5,245,990 | A | 9/1993 | Bertinin |
| 5,259,397 | A | 11/1993 | McCabe |
| 5,261,871 | A | 11/1993 | Greenfield |
| 5,263,473 | A | 11/1993 | McWhorter |
| 5,275,588 | A | 1/1994 | Matsumoto et al. |
| 5,277,695 | A | 1/1994 | Johnson, Jr. et al. |
| 5,277,697 | A | 1/1994 | France et al. |
| 5,288,286 | A | 2/1994 | Davis |
| 5,312,431 | A | 5/1994 | McEwen |
| 5,314,455 | A | 5/1994 | Johnson, Jr. et al. |
| 5,334,135 | A | 8/1994 | Grim et al. |
| 5,342,285 | A | 8/1994 | Dye |
| 5,354,260 | A | 10/1994 | Cook |
| 5,378,224 | A | 1/1995 | Billotti |
| 5,383,894 | A | 1/1995 | Dye |
| 5,383,919 | A | 1/1995 | Kelly et al. |
| 5,385,538 | A | 1/1995 | Mann |
| 5,389,065 | A | 2/1995 | Johnson, Jr. |
| 5,391,141 | A | 2/1995 | Hamilton |
| 5,399,153 | A | 3/1995 | Caprio, Jr. et al. |
| 5,403,265 | A | 4/1995 | Berguer et al. |
| 5,406,661 | A | 4/1995 | Pekar |
| 5,407,421 | A | 4/1995 | Goldsmith |
| D358,216 | S | 5/1995 | Dye |
| 5,413,582 | A | 5/1995 | Eaton |
| 5,419,757 | A | 5/1995 | Daneshvar |
| 5,425,701 | A | 6/1995 | Oster et al. |
| 5,435,009 | A | 7/1995 | Schild et al. |
| 5,437,595 | A | 8/1995 | Smith |
| 5,437,610 | A | 8/1995 | Cariapa et al. |
| 5,441,533 | A | 8/1995 | Johnson et al. |
| 5,443,440 | A | 8/1995 | Tumey et al. |
| 5,449,341 | A | 9/1995 | Harris |
| 5,449,379 | A | 9/1995 | Hadtke |
| 5,450,858 | A | 9/1995 | Zablotsky et al. |
| 5,451,201 | A | 9/1995 | Prengler |
| 5,453,081 | A | 9/1995 | Hansen |
| 5,455,969 | A | 10/1995 | Pratson et al. |
| 5,458,265 | A | 10/1995 | Hester et al. |
| 5,462,517 | A | 10/1995 | Mann |
| 5,466,250 | A | 11/1995 | Johnson, Jr. et al. |
| 5,470,156 | A | 11/1995 | May |
| 5,478,119 | A | 12/1995 | Dye |
| 5,489,259 | A | 2/1996 | Jacobs et al. |
| 5,496,262 | A | 3/1996 | Johnson, Jr. et al. |
| 5,503,620 | A | 4/1996 | Danzger |
| 5,511,552 | A | 4/1996 | Johnson |
| 5,513,658 | A | 5/1996 | Goseki |
| 5,514,081 | A | 5/1996 | Mann |
| 5,514,155 | A | 5/1996 | Daneshvar |
| 5,554,105 | A | 9/1996 | Taylor |
| D376,013 | S | 11/1996 | Sandman et al. |
| 5,575,762 | A | 11/1996 | Peeler et al. |
| 5,578,055 | A | 11/1996 | McEwen |
| 5,584,798 | A | 12/1996 | Fox |
| 5,588,954 | A | 12/1996 | Ribando et al. |
| 5,588,955 | A | 12/1996 | Johnson, Jr. et al. |
| 5,588,956 | A | 12/1996 | Billotti |
| 5,591,200 | A | 1/1997 | Cone et al. |
| 5,591,337 | A | 1/1997 | Lynn et al. |
| 5,603,690 | A | 2/1997 | Barry |
| 5,609,570 | A | 3/1997 | Lamont |
| 5,620,411 | A | 4/1997 | Schumann et al. |
| 5,622,113 | A | 4/1997 | Hansen |
| 5,626,556 | A | 5/1997 | Tobler et al. |
| 5,626,557 | A | 5/1997 | Mann |
| 5,634,889 | A | 6/1997 | Gardner et al. |
| 5,637,106 | A | 6/1997 | Mitchell et al. |
| 5,640,714 | A | 6/1997 | Tanaka |
| 5,649,954 | A | 7/1997 | McEwen |
| 5,653,244 | A | 8/1997 | Shaw |
| D383,547 | S | 9/1997 | Mason et al. |
| 5,664,270 | A | 9/1997 | Bell et al. |
| 5,669,872 | A | 9/1997 | Fox |
| 5,673,028 | A | 9/1997 | Levy |
| 5,674,262 | A | 10/1997 | Tumey |
| 5,695,453 | A | 12/1997 | Neal |
| 5,704,999 | A | 1/1998 | Lukich et al. |
| 5,711,757 | A | 1/1998 | Bryant |
| 5,711,760 | A | 1/1998 | Ibrahim |
| 5,717,996 | A | 2/1998 | Feldmann |
| 5,720,739 | A | 2/1998 | Hilston et al. |
| 5,728,055 | A | 3/1998 | Sebastian |
| 5,728,057 | A | 3/1998 | Ouellette et al. |
| 5,730,710 | A | 3/1998 | Eichhorn et al. |
| 5,733,304 | A | 3/1998 | Spence |
| 5,741,295 | A | 4/1998 | McEwen |
| 5,746,213 | A | 5/1998 | Marks |
| 5,759,167 | A | 6/1998 | Shields et al. |
| 5,765,298 | A | 6/1998 | Potter et al. |
| 5,769,800 | A | 6/1998 | Gelfand et al. |
| 5,769,801 | A | 6/1998 | Tumey et al. |
| 5,790,998 | A | 8/1998 | Crescimbeni |
| 5,795,312 | A | 8/1998 | Dye |
| 5,797,851 | A | 8/1998 | Byrd |
| 5,823,981 | A | 10/1998 | Grim et al. |
| 5,833,639 | A | 11/1998 | Nunes et al. |
| 5,840,049 | A | 11/1998 | Tumey et al. |
| 5,843,007 | A | 12/1998 | McEwen et al. |
| D403,775 | S | 1/1999 | Davis et al. |
| D405,884 | S | 2/1999 | Roper |
| 5,876,359 | A | 3/1999 | Bock et al. |
| 5,891,065 | A | 4/1999 | Cariapa et al. |
| 5,894,682 | A | 4/1999 | Broz |
| D411,301 | S | 6/1999 | Hampson et al. |
| 5,916,183 | A | 6/1999 | Reid |
| 5,925,010 | A | 7/1999 | Caprio, Jr. |
| 5,926,850 | A | 7/1999 | Han |
| 5,938,628 | A | 8/1999 | Oguri et al. |
| 5,951,502 | A | 9/1999 | Peeler et al. |
| 5,957,872 | A | 9/1999 | Flick |
| 5,966,763 | A | 10/1999 | Thomas et al. |
| 5,968,072 | A | 10/1999 | Hite et al. |
| 5,970,519 | A | 10/1999 | Weber |
| 5,976,099 | A | 11/1999 | Kellogg |
| 5,976,300 | A | 11/1999 | Buchanan et al. |
| 5,988,704 | A | 11/1999 | Ryhman |
| 5,989,204 | A | 11/1999 | Lina |
| 5,991,654 | A | 11/1999 | Tumey et al. |
| 5,997,495 | A | 12/1999 | Cook et al. |
| 5,997,981 | A | 12/1999 | McCormack et al. |
| 6,001,119 | A | 12/1999 | Hampson et al. |
| 6,007,559 | A | 12/1999 | Arkans |
| 6,010,471 | A | 1/2000 | Ben-Noon |
| 6,021,780 | A | 2/2000 | Darby |
| 6,036,718 | A | 3/2000 | Ledford et al. |
| 6,048,326 | A | 4/2000 | Davis et al. |
| 6,051,016 | A | 4/2000 | Mesaros et al. |
| 6,056,713 | A | 5/2000 | Hayashi |
| 6,062,244 | A | 5/2000 | Arkans |
| 6,066,217 | A | 5/2000 | Dibble et al. |
| 6,076,193 | A | 6/2000 | Hood |
| 6,080,120 | A | 6/2000 | Sandman et al. |
| D428,153 | S | 7/2000 | Davis |
| 6,110,135 | A | 8/2000 | Madow et al. |
| 6,120,469 | A | 9/2000 | Bruder |
| 6,126,683 | A | 10/2000 | Momtaheni |
| 6,129,688 | A | 10/2000 | Arkans |
| 6,129,695 | A | 10/2000 | Peters et al. |
| 6,134,720 | A | 10/2000 | Foreman |
| 6,135,116 | A | 10/2000 | Vogel et al. |
| 6,145,143 | A | 11/2000 | Hicks et al. |
| 6,149,600 | A | 11/2000 | Poorman-Ketchum |
| 6,149,616 | A | 11/2000 | Szlema et al. |
| 6,152,495 | A | 11/2000 | Hoffmann et al. |
| 6,152,893 | A | 11/2000 | Pigg et al. |
| 6,168,539 | B1 | 1/2001 | Maina |
| 6,171,271 | B1 | 1/2001 | Hörnberg |
| 6,179,796 | B1 | 1/2001 | Waldridge |

(56) References Cited

U.S. PATENT DOCUMENTS 6,197,045 B1 3/2001 Carson
6,203,510 B1 3/2001 Takeuchi et al.
6,209,159 B1 4/2001 Murphy
6,212,719 B1 4/2001 Thomas et al.
6,231,507 B1 5/2001 Zikorus et al.
6,231,532 B1 5/2001 Watson et al.
6,245,023 B1 6/2001 Clemmons
6,254,554 B1 7/2001 Turtzo
6,257,626 B1 7/2001 Campau
6,257,627 B1 7/2001 Fujiwara et al.
6,260,201 B1 7/2001 Rankin
6,290,662 B1 9/2001 Morris et al.
6,290,664 B1 9/2001 Nauert
6,315,745 B1 11/2001 Kloecker
6,319,215 B1 11/2001 Manor et al.
6,322,530 B1 11/2001 Johnson, Jr. et al.
6,336,935 B1 1/2002 Davis et al.
6,338,723 B1 1/2002 Carpenter et al.
6,349,506 B1 2/2002 Pace et al.
6,358,219 B1 3/2002 Arkans
6,368,357 B1 4/2002 Schon et al.
6,375,633 B1 4/2002 Endress et al.
6,385,778 B1 5/2002 Johnson
6,385,864 B1 5/2002 Sell, Jr. et al.
6,387,065 B1 5/2002 Tumey
6,402,879 B1 6/2002 Tawney et al.
6,409,691 B1 6/2002 Dakin et al.
6,423,053 B1 7/2002 Lee
6,436,064 B1 8/2002 Kloecker
6,440,093 B1 8/2002 McEwen et al.
6,447,460 B1 9/2002 Zheng et al.
6,463,934 B1 10/2002 Johnson, Jr. et al.
6,468,237 B1 10/2002 Lina
6,478,757 B1 11/2002 Barak
6,478,761 B2 11/2002 Bracamonte-Sommer
6,488,643 B1 12/2002 Tumey et al.
6,494,852 B1 12/2002 Barak et al.
6,508,205 B1 1/2003 Zink
6,520,926 B2 2/2003 Hall
6,526,597 B1 3/2003 Shepard
6,527,727 B2 3/2003 Itonaga et al.
6,537,298 B2 3/2003 Dedo
6,540,707 B1 4/2003 Stark et al.
6,544,202 B2 4/2003 McEwen et al.
6,549,748 B2 4/2003 Miura
6,551,280 B1 4/2003 Knighton et al.
6,554,785 B1 4/2003 Sroufe et al.
6,557,704 B1 5/2003 Randolph
6,558,338 B1 5/2003 Wasserman
6,589,267 B1 7/2003 Hui
6,589,534 B1 7/2003 Shaul et al.
6,592,534 B1 7/2003 Rutt et al.
6,593,508 B1 7/2003 Harder
6,598,249 B2 7/2003 Pajanacci et al.
D478,995 S 8/2003 Cipra et al.
6,616,622 B1 9/2003 Barberio
6,618,859 B1 9/2003 Kadymir et al.
6,629,941 B1 10/2003 Ishibashi et al.
6,645,165 B2 11/2003 Waldridge et al.
D484,986 S 1/2004 Cipra et al.
6,676,614 B1 1/2004 Hansen et al.
6,682,547 B2 1/2004 McEwen et al.
6,685,661 B2 2/2004 Peled
6,719,711 B1 4/2004 Islava
6,726,641 B2 4/2004 Chiang et al.
6,746,470 B2 6/2004 McEwen et al.
6,762,337 B2 7/2004 Boukanov et al.
6,762,338 B2 7/2004 Harder
6,842,915 B2 1/2005 Turner et al.
6,846,294 B2 1/2005 Rastegar et al.
6,846,295 B1 1/2005 Ben-Nun
6,849,057 B2 2/2005 Satou et al.
6,852,089 B2 2/2005 Kloecker et al.
6,860,862 B2 3/2005 Waldridge et al.
6,862,989 B2 3/2005 Belanger et al.
6,866,636 B2 3/2005 Inoue et al.
6,869,409 B2 3/2005 Rothman et al.
D506,553 S 6/2005 Tesluk
6,945,944 B2 9/2005 Kuiper et al.
D510,626 S 10/2005 Krahner et al.
6,973,690 B2 12/2005 Muci et al.
6,984,215 B2 1/2006 Shah et al.
6,991,613 B2 1/2006 Sensabaugh
7,011,640 B2 3/2006 Patterson et al.
7,022,096 B1 4/2006 Alfieri
7,041,074 B1 5/2006 Averianov et al.
7,044,924 B1 5/2006 Roth et al.
7,048,703 B2 5/2006 Riach
7,090,500 B1 8/2006 Guttman
D533,668 S 12/2006 Brown
7,166,077 B2 1/2007 Millay et al.
7,217,249 B2 5/2007 Scott
D545,972 S 7/2007 Wieringa et al.
7,237,272 B2 7/2007 Botcher
7,238,080 B2 7/2007 Gimble
7,258,676 B2 * 8/2007 Calderon et al. ..... 602/13
D550,367 S 9/2007 Nash
7,276,037 B2 10/2007 Ravikumar
7,276,039 B2 10/2007 Garelick et al.
7,278,980 B1 10/2007 Garelick et al.
7,282,038 B2 10/2007 Gillis et al.
7,285,103 B2 10/2007 Nathanson
7,288,076 B2 10/2007 Grim et al.
7,297,128 B2 11/2007 Binder et al.
7,300,410 B1 11/2007 Weber
7,303,539 B2 12/2007 Binder et al.
7,306,568 B2 12/2007 Diana
7,310,847 B2 12/2007 Bolkan et al.
7,318,812 B2 1/2008 Taylor et al.
D562,461 S 2/2008 Nash
D562,462 S 2/2008 Muir et al.
7,326,227 B2 2/2008 Dedo et al.
7,329,232 B2 2/2008 Lipshaw et al.
7,351,217 B2 4/2008 Scherpenborg
7,353,770 B2 4/2008 Sanguinetti
7,354,410 B2 4/2008 Perry et al.
7,354,411 B2 4/2008 Perry et al.
7,374,550 B2 5/2008 Hansen et al.
D577,124 S 9/2008 Freeland et al.
7,424,936 B2 9/2008 McClellan
7,442,175 B2 10/2008 Meyer et al.
7,465,283 B2 12/2008 Grim et al.
7,468,048 B2 12/2008 Meehan
7,473,816 B2 1/2009 Hall
D594,561 S 6/2009 Freeland et al.
7,543,399 B2 6/2009 Kilgore et al.
7,556,707 B2 7/2009 Giori
7,559,908 B2 7/2009 Ravikumar
7,578,799 B2 8/2009 Thorsteinsson et al.
7,591,796 B1 9/2009 Barak et al.
7,591,797 B2 9/2009 Hakonson et al.
7,597,675 B2 10/2009 Ingimundarson et al.
7,615,027 B2 11/2009 Nordt, III et al.
7,618,384 B2 11/2009 Nardi et al.
7,618,389 B2 11/2009 Nordt, III et al.
7,625,348 B2 12/2009 Young et al.
7,637,879 B2 12/2009 Barak et al.
D608,006 S 1/2010 Avitable et al.
7,654,117 B2 2/2010 Barnett
7,748,090 B2 7/2010 Seth et al.
7,749,182 B2 7/2010 Gramza et al.
7,758,607 B2 7/2010 McEwen et al.
7,766,890 B2 8/2010 Ito et al.
7,771,376 B2 8/2010 Roth et al.
7,780,614 B2 8/2010 Bruce et al.
7,780,698 B2 8/2010 McEwen et al.
7,803,358 B2 9/2010 Gordan et al.
7,827,624 B1 11/2010 Cole
7,871,385 B2 1/2011 Levinson
7,874,997 B2 1/2011 Jaccard
7,882,568 B2 2/2011 Fee
7,931,606 B2 4/2011 Meyer
7,967,766 B2 6/2011 Ravikumar
7,976,487 B2 7/2011 Gramza et al.

(56) References Cited

U.S. PATENT DOCUMENTS

| | | | | |
|---|---|---|---|---|
| 8,002,721 | B2 | 8/2011 | Bretl et al. | |
| 8,016,778 | B2 | 9/2011 | Brown et al. | |
| 8,016,779 | B2 | 9/2011 | Brown et al. | |
| 8,021,388 | B2 | 9/2011 | Brown et al. | |
| 8,029,450 | B2 | 10/2011 | Brown et al. | |
| 8,029,451 | B2 | 10/2011 | Meyer et al. | |
| 8,034,007 | B2 | 10/2011 | Avitable et al. | |
| 8,034,013 | B2 | 10/2011 | Winkler | |
| 8,114,117 | B2 | 2/2012 | Avitable | |
| 8,177,734 | B2 | 5/2012 | Vess | |
| 8,419,666 | B2 | 4/2013 | Liu et al. | |
| 2001/0018564 | A1 | 8/2001 | Manor et al. | |
| 2002/0068886 | A1 | 6/2002 | Lin | |
| 2002/0069731 | A1 | 6/2002 | Soucy | |
| 2002/0115949 | A1 | 8/2002 | Kuslich et al. | |
| 2002/0121235 | A1 | 9/2002 | Carpenter et al. | |
| 2003/0018313 | A1 | 1/2003 | Tanzer et al. | |
| 2003/0083605 | A1 | 5/2003 | Edmund | |
| 2003/0199922 | A1 | 10/2003 | Buckman | |
| 2004/0010212 | A1 | 1/2004 | Kuiper et al. | |
| 2004/0039317 | A1 | 2/2004 | Souney et al. | |
| 2004/0039413 | A1 | 2/2004 | Akerfeldt et al. | |
| 2004/0054306 | A1 | 3/2004 | Roth et al. | |
| 2004/0068290 | A1 | 4/2004 | Bates et al. | |
| 2004/0097860 | A1 | 5/2004 | Tauber | |
| 2004/0158283 | A1 | 8/2004 | Shook et al. | |
| 2004/0158285 | A1 | 8/2004 | Pillai | |
| 2004/0176715 | A1 | 9/2004 | Nelson | |
| 2004/0181156 | A1 | 9/2004 | Kingsford et al. | |
| 2004/0181254 | A1 | 9/2004 | Choi et al. | |
| 2004/0199090 | A1 | 10/2004 | Sanders et al. | |
| 2004/0210167 | A1 | 10/2004 | Webster | |
| 2004/0236258 | A1 | 11/2004 | Burns et al. | |
| 2005/0070828 | A1 | 3/2005 | Hampson et al. | |
| 2005/0154336 | A1 | 7/2005 | Kloecker et al. | |
| 2005/0209545 | A1 | 9/2005 | Farrow et al. | |
| 2005/0242315 | A1 | 11/2005 | Lund | |
| 2006/0010574 | A1 | 1/2006 | Linnane et al. | |
| 2006/0020236 | A1 | 1/2006 | Ben-Nun | |
| 2006/0026736 | A1 | 2/2006 | Nordt et al. | |
| 2006/0089617 | A1 | 4/2006 | Bunnelle | |
| 2006/0102423 | A1 | 5/2006 | Lang et al. | |
| 2006/0135894 | A1 | 6/2006 | Linnane et al. | |
| 2006/0137072 | A1 | 6/2006 | Visco et al. | |
| 2006/0142719 | A1 | 6/2006 | Vogt et al. | |
| 2006/0189907 | A1 | 8/2006 | Pick et al. | |
| 2006/0211965 | A1 | 9/2006 | Horn et al. | |
| 2006/0287672 | A1 | 12/2006 | McEwen et al. | |
| 2006/0293151 | A1 | 12/2006 | Rast | |
| 2007/0038167 | A1 | 2/2007 | Tabron et al. | |
| 2007/0055188 | A1* | 3/2007 | Avni et al. | 601/151 |
| 2007/0129658 | A1 | 6/2007 | Hampson et al. | |
| 2007/0130732 | A1 | 6/2007 | Matsumura et al. | |
| 2007/0135835 | A1 | 6/2007 | McEwen et al. | |
| 2007/0135836 | A1 | 6/2007 | McEwen et al. | |
| 2007/0179416 | A1 | 8/2007 | Obrien et al. | |
| 2007/0260162 | A1 | 11/2007 | Meyer et al. | |
| 2007/0264497 | A1 | 11/2007 | Kong | |
| 2007/0276310 | A1 | 11/2007 | Lipshaw et al. | |
| 2007/0276311 | A1 | 11/2007 | Wieringa et al. | |
| 2007/0282233 | A1 | 12/2007 | Meyer et al. | |
| 2008/0000477 | A1 | 1/2008 | Huster et al. | |
| 2008/0004555 | A1 | 1/2008 | Reis et al. | |
| 2008/0004560 | A1 | 1/2008 | Miskie | |
| 2008/0023423 | A1 | 1/2008 | Duffy | |
| 2008/0072629 | A1 | 3/2008 | Gehring | |
| 2008/0086071 | A1 | 4/2008 | Weatherly | |
| 2008/0087740 | A1 | 4/2008 | Gusenoff et al. | |
| 2008/0103397 | A1 | 5/2008 | Barak | |
| 2008/0103422 | A1 | 5/2008 | Perry et al. | |
| 2008/0141428 | A1 | 6/2008 | Kapah et al. | |
| 2008/0143007 | A1 | 6/2008 | Tuma | |
| 2008/0183115 | A1 | 7/2008 | Pierce | |
| 2008/0188786 | A1 | 8/2008 | Hickling | |
| 2008/0208092 | A1 | 8/2008 | Sawa | |
| 2008/0234615 | A1 | 9/2008 | Cook et al. | |
| 2008/0243173 | A1 | 10/2008 | Thorpe | |
| 2008/0245361 | A1 | 10/2008 | Brown | |
| 2008/0249440 | A1 | 10/2008 | Avitable et al. | |
| 2008/0249441 | A1 | 10/2008 | Avitable et al. | |
| 2008/0249443 | A1 | 10/2008 | Avitable et al. | |
| 2008/0249449 | A1 | 10/2008 | Brown et al. | |
| 2008/0249559 | A1* | 10/2008 | Brown et al. | 606/202 |
| 2008/0250551 | A1 | 10/2008 | Mazzarolo | |
| 2008/0255485 | A1 | 10/2008 | Johnson et al. | |
| 2008/0281351 | A1 | 11/2008 | Croushorn et al. | |
| 2008/0306420 | A1 | 12/2008 | Vess | |
| 2008/0312682 | A1 | 12/2008 | Shams et al. | |
| 2009/0005718 | A1 | 1/2009 | Lightbourne | |
| 2009/0064919 | A1 | 3/2009 | Greenwald | |
| 2009/0082708 | A1 | 3/2009 | Scott et al. | |
| 2009/0099562 | A1 | 4/2009 | Ingimudarson et al. | |
| 2009/0110890 | A1 | 4/2009 | Garza et al. | |
| 2009/0124944 | A1 | 5/2009 | Ravikumar | |
| 2009/0133446 | A1 | 5/2009 | Burrow et al. | |
| 2009/0137938 | A1 | 5/2009 | Parivash | |
| 2009/0163842 | A1 | 6/2009 | Cropper | |
| 2009/0171223 | A1 | 7/2009 | McEwen et al. | |
| 2009/0198160 | A1 | 8/2009 | Coyne | |
| 2009/0198261 | A1 | 8/2009 | Schweikert | |
| 2009/0227917 | A1 | 9/2009 | Nardi | |
| 2009/0227919 | A1 | 9/2009 | Nardi et al. | |
| 2009/0227922 | A1 | 9/2009 | Nardi et al. | |
| 2009/0234265 | A1 | 9/2009 | Reid, Jr. et al. | |
| 2009/0270910 | A1 | 10/2009 | Hargens et al. | |
| 2009/0278707 | A1 | 11/2009 | Biggins et al. | |
| 2009/0281470 | A1 | 11/2009 | Sandusky et al. | |
| 2009/0299249 | A1 | 12/2009 | Wilkes et al. | |
| 2009/0312681 | A1 | 12/2009 | McSpadden et al. | |
| 2009/0320174 | A1 | 12/2009 | Turner | |
| 2009/0326576 | A1 | 12/2009 | Ben-Nun | |
| 2010/0004575 | A1 | 1/2010 | Vess | |
| 2010/0004676 | A1 | 1/2010 | McEwen et al. | |
| 2010/0010408 | A1 | 1/2010 | Linares | |
| 2010/0016771 | A1 | 1/2010 | Arbesman et al. | |
| 2010/0022930 | A1 | 1/2010 | Koby et al. | |
| 2010/0037369 | A1 | 2/2010 | Reichert | |
| 2010/0042026 | A1 | 2/2010 | Kloecker et al. | |
| 2010/0042028 | A1 | 2/2010 | Frank et al. | |
| 2010/0081974 | A1 | 4/2010 | Vess | |
| 2010/0081975 | A1 | 4/2010 | Avitable et al. | |
| 2010/0081977 | A1* | 4/2010 | Vess | 602/13 |
| 2010/0210982 | A1 | 8/2010 | Balachandran et al. | |
| 2010/0268130 | A1* | 10/2010 | Khan | 601/46 |
| 2012/0071801 | A1 | 3/2012 | Avitable | |
| 2012/0078146 | A1 | 3/2012 | Deshpande | |
| 2013/0184623 | A1 | 7/2013 | Fraser | |
| 2013/0310719 | A1 | 11/2013 | Davis et al. | |
| 2014/0236058 | A1 | 8/2014 | Lee | |

FOREIGN PATENT DOCUMENTS

| | | | |
|---|---|---|---|
| DE | 19846922 | A1 | 10/2011 |
| EP | 0221636 | A1 | 5/1987 |
| EP | 0303029 | A1 | 2/1989 |
| EP | 0408049 | A2 | 1/1991 |
| EP | 0861651 | A1 | 9/1998 |
| EP | 0893115 | A2 | 1/1999 |
| EP | 1468816 | A1 | 10/2004 |
| FR | 2813770 | A1 | 3/2002 |
| FR | 2950245 | A | 3/2011 |
| GB | 2061086 | A | 5/1981 |
| GB | 2178663 | A | 2/1987 |
| GB | 2183483 | A | 6/1987 |
| GB | 2313784 | A | 12/1997 |
| GB | 2373444 | A | 9/2002 |
| JP | 59218154 | A | 12/1984 |
| JP | 60135110 | U | 9/1985 |
| JP | 09262261 | A | 9/1997 |
| JP | 2002065782 | | 3/2002 |
| JP | 2003310312 | A | 11/2003 |
| JP | 2004081709 | | 3/2004 |
| JP | 2005066247 | | 3/2005 |
| JP | 2009000277 | A | 1/2009 |

(56) References Cited

FOREIGN PATENT DOCUMENTS

| | | | |
|---|---|---|---|
| WO | 96/20685 | A1 | 7/1996 |
| WO | 2004021950 | A1 | 3/2004 |
| WO | 2005082315 | A1 | 9/2005 |
| WO | 2006039242 | A2 | 4/2006 |
| WO | 2006083865 | A2 | 8/2006 |

OTHER PUBLICATIONS

Mittelman, Jonathan S., MD: "Effectiveness of Leg Compression in Preventing Venous Stasis", The American Journal of Surgery, Dec. 1982, p. 611-613, vol. 144, No. 6, Elsevier Publ., Bridgewater, NJ, USA.
Tyco Healthcare Kendall, SCD Response Catalog, Mar. 2000, pp. 1-2.
Tyco Healthcare Kendall, SCD Soft Sleeve Catalog, Apr. 2001, pp. 1-2.
The Kendall Company, Vascular Therapy Products Catalog, Jan. 1996, pp. 8-5 thru 8-7.
The Kendall Company, The New SCD Compression Sleeve, Aug. 1993, pp. 1-2.
Tyco Healthcare Kendall, Prevention Gets Personal Mar. 2001, pp. 1, 2, 4.
Kendall SCD, Sequential Compression Sleeves, Patent Information, Jan. 1993, 6 pgs.
Ramsley and Bushnell, "Development of the US Woodland Battle Dress Uniform", Jan. 1981, p. 8 paragraph 4.
European Search Report for EP 13 16 3919 dated Oct. 11, 2013, 5 pages.
Office Action dated Oct. 27, 2014 in related Chinese application 201310220103.4, 19 pages.
Office Action dated May 7, 2014 in related Australian Application Serial No. 2013204544, 3 pages.
Office action issued Feb. 25, 2015 in related Korean Patent Application Serial No. 10-2013-0068775, 9 pages.
Office action issued Jan. 26, 2015 in related Taiwanese Patent Application Serial No. 102116093, 13 pages.
Office action issued Feb. 25 2015 in related Korean Patent Application Serial No. 102116093, 9 pages.
Office Action dated May 29, 2015 in related Chinese patent application serial No. 201310220103.4, 16 pages.

* cited by examiner

COMPRESSION SYSTEM WITH VENT COOLING FEATURE

FIELD OF THE INVENTION

The present invention generally relates to a compression device for applying compression therapy to a body part of a wearer.

BACKGROUND OF THE INVENTION

Generally, intermittent pneumatic compression (IPC) systems for deep vein thrombosis (DVT) prophylaxis consist of a controller having a pump and associated control electronics, a compression sleeve (e.g., a sequential compression sleeve) which is applied to the patient's body part, and tubing sets that communicate between the pump and the sleeve.

Sequential compression sleeves are typically constructed of two sheets of fluid impermeable material joined at seams to define one or more fluid impervious bladders. The tubing connects the bladders to the pump for inflating the bladders to apply compressive pressure around the patient's body parts. Typically, the controller is programmed to perform cyclic compression by pumping air into the bladders of the sleeve during a compression segment of the cycle followed by exhausting air from the bladders during a deflation segment of the cycle. The air exhausts through one or more exhaust ports associated with the controller (see Prior Art FIGS. 1 and 2). The exhaust ports usually vent to atmosphere around the patient, deflating the sleeve to enable blood to reenter the veins.

The bladders may be covered with a laminate to improve durability and protect against puncture. The impermeability of the sleeve can trap moisture (i.e., perspiration) between the bladder sheets and the patient's body, causing some discomfort. Discomfort can lead to the patient's unwillingness to wear the sleeve, potentially endangering the patient's health.

An advancement in this field has been to place the controller directly on the sleeve, eliminating the need for long and unwieldy tubing sets. These systems, though portable, do not address the issues of moisture build-up that can occur with conventional compression sleeves.

The present invention provides an improved arrangement for reducing moisture build-up and improving patient compliance.

SUMMARY OF THE INVENTION

In one aspect, the present invention includes a compression device for providing compression treatment to a limb of a wearer. The device comprises a compression garment positionable on the limb of the wearer. The garment comprises an inflatable bladder for providing compression treatment to a compression region of the limb. The device also includes a controller fluidly connected to the inflatable bladder and configured for inflating and deflating the bladder during a compression cycle. The controller includes an exhaust port positioned to direct exhaust fluid toward the compression region as the bladder deflates so exhaust fluid flows over the limb of the wearer to cool the limb.

In another aspect, the invention includes a method of providing compression treatment to a limb of a wearer using a compression device including an inflatable bladder positioned on the limb of the wearer and a controller fluidly connected to the inflatable bladder. The method comprises pressurizing the inflatable bladder with pressurized fluid from the controller to inflate the bladder and compress a compression region of the limb. Further, the inflatable bladder is depressurized by venting the pressurized fluid out of the inflatable bladder. The method includes exhausting the vented fluid out of the controller through an exhaust port in the controller and directing the vented fluid toward the compression region of the limb to cool the limb.

In still another aspect, the present invention includes a compression device for providing compression treatment to a limb of a wearer. The device comprises a compression garment positionable on the limb of the wearer. The garment comprises an inflatable bladder for providing compression treatment to a compression region of the limb. The garment has an opening and a controller fluidly connected to the inflatable bladder and configured for inflating and deflating the bladder during a compression cycle. The controller includes an exhaust port positioned to direct exhaust fluid through the opening in the garment and to direct the exhaust fluid toward the compression region as the bladder deflates so exhaust fluid flows over the limb of the wearer to cool the limb. The device also includes a guide attached to the bladder around the opening for guiding fluid directed to the opening to flow over the limb of the wearer.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
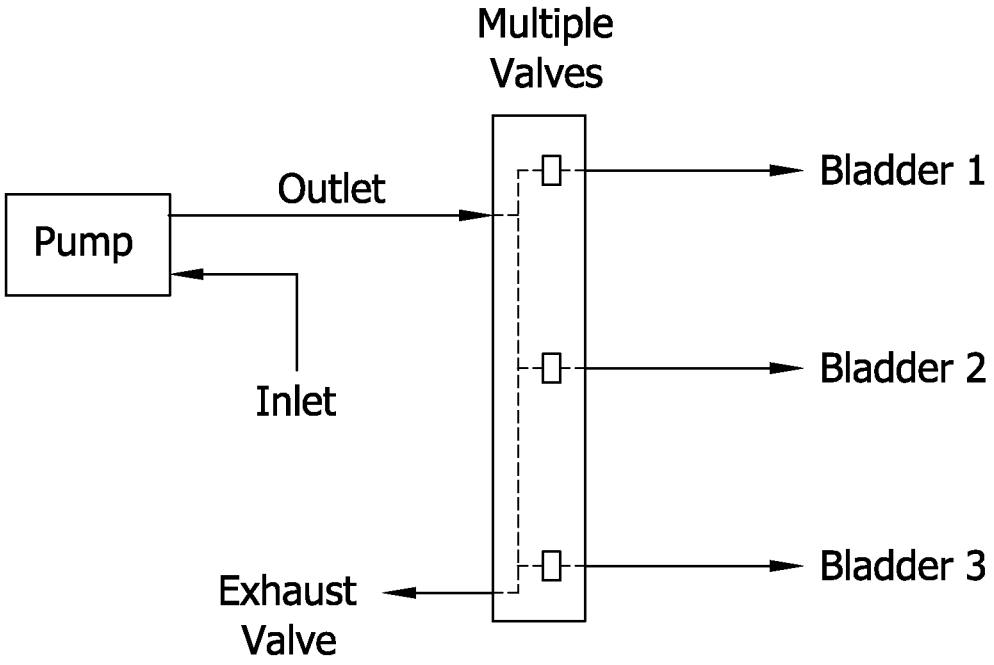
FIG. 1 Prior Art
FIG. 1 is a schematic of a first configuration of a prior art compression device.
Figure 2:
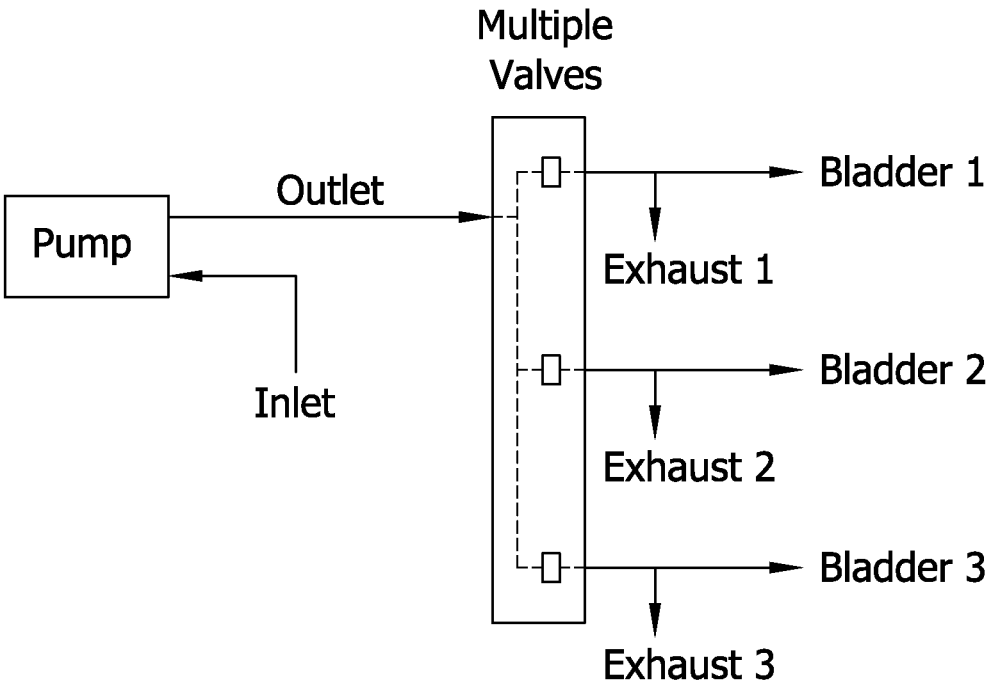
FIG. 2 Prior Art
FIG. 2 is a schematic of a second configuration of a prior art compression device.
Figure 3:
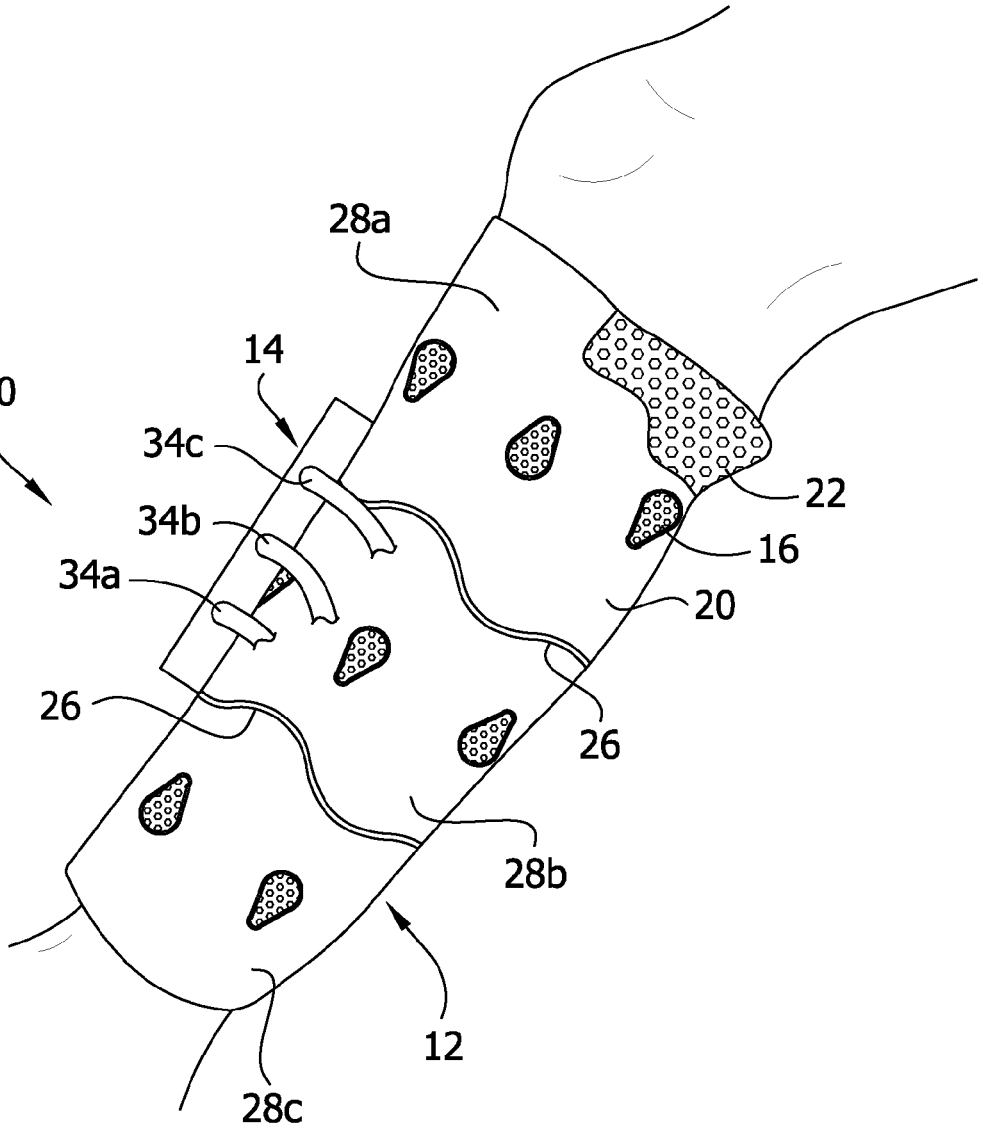
FIG. 3 is a perspective of a compression device of the present invention secured to a leg of a wearer with portions of the device partially removed to show underlying layers.
Figure 4:
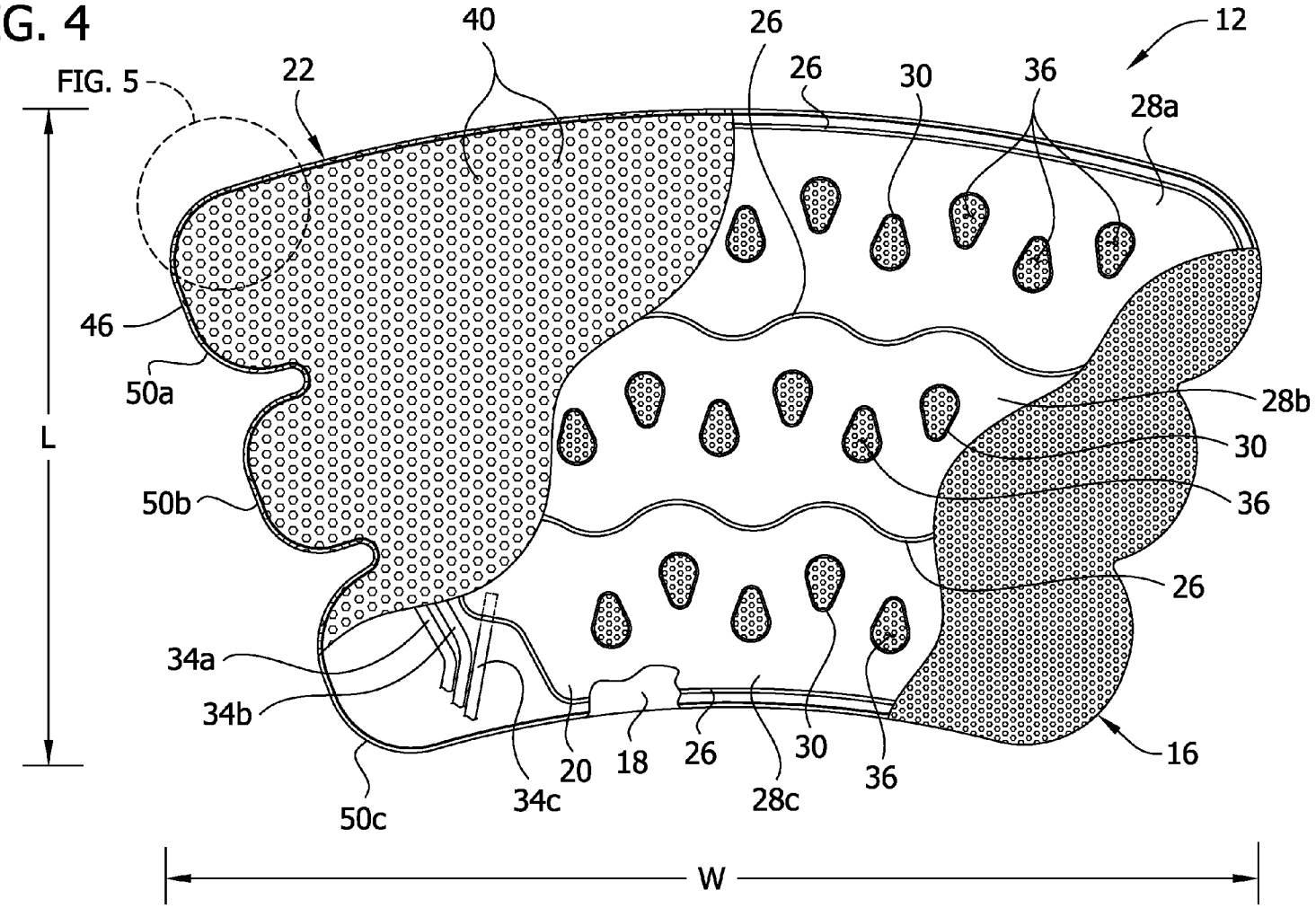
FIG. 4 is a front elevation of a compression sleeve of the compression device with an outer cover and intermediate layers of the sleeve partially removed to show underlying layers.

Referring now to the drawings and in particular to FIGS. 3 and 4, a compression device for applying cyclical compression therapy to a limb (e.g., a leg) of a wearer is indicated in its entirety by the reference number 10. The compression device 10 comprises a compression sleeve 12 and a controller 14 (or "air compressor unit") directly attached to the compression sleeve for supplying pressurized fluid to the sleeve 12 for providing compression therapy to the limb. The compression device 10 has a portable configuration such that the wearer of the device can more easily move about while wearing the device. However, the controller 14 may have a configuration other than portable such that the controller is not directly attached to the sleeve 12 without departing from the scope of the invention.

The compression sleeve 12 is of the type sized and shaped for being disposed around a leg of the wearer, but could be configured to be applied to other parts of the wearer's body. More specifically, the sleeve 12 has a width W (FIG. 4) for being wrapped around a full circumference of the leg and a length L for running from the ankle to a knee of the leg. This type of sleeve is generally referred to in the art as a knee-length sleeve. It will be understood that a compression sleeve may come in different sizes, such as a thigh-length sleeve (not shown) extending from the ankle to the thigh of the leg. It is understood that compression devices having other configurations for being disposed about other parts of the wearer's body, are also within the scope of this invention, such as a wrap around a patient's chest in the treatment of breast cancer.

Referring to FIG. 4, the compression sleeve 12 may comprise four layers secured together. The scope of the present invention, however, is not limited to four layers (FIG. 3 shows the compression sleeve 12 having only two layers.) In the illustrated embodiment, the compression sleeve 12 comprises an inner layer, generally indicated by 16, on which a first intermediate layer (broadly, a first bladder layer), generally indicated by 18, is overlaid. A second intermediate layer (broadly, a second bladder layer), generally indicated by 20, overlies the first intermediate layer 18 and is secured thereto. An outer cover generally indicated by 22, overlies and is secured to the second intermediate layer 20. In use, the inner layer 16 will contact the limb of the wearer, and the outer cover 22 will be farthest from the limb of the wearer. If the sleeve 12 is constructed using only two layers of material (e.g., two bladder layers 18, 20), then the first bladder layer 18 will contact the limb of the wearer, and the second bladder layer 20 will be farther from the limb of the wearer (see FIG. 3).

The layers have the same shape and are superposed on each other so edges of the layers generally coincide. It is contemplated that one or more of the layers 16, 18, 20, or 22 may not be superposed on a corresponding layer, but slightly offset to accommodate a particular feature of a patient's limb. Moreover, the number of sheets making up the compression sleeve 12 may be other than described.

The first and second intermediate layers 18, 20, respectively, each include a single sheet of elastic material (broadly, "bladder material"). For example, the sheets 18 and 20 are made of a pliable PVC material having a thickness of about 0.006 inch. The inner and outer layers 16 and 22 can be made of a polyester material having a thickness of about 0.005 inch. The materials and thicknesses of the layers may vary to add strength or to cause more expansion in one direction, such as toward the limb, during inflation. The second intermediate layer 20 may be secured to the first intermediate layer 18 along bladder seam lines 26 defining a proximal bladder 28*a*, an intermediate bladder 28*b* and a distal bladder 28*c*, respectively, that are spaced longitudinally along the length L of the sleeve 12. The number of bladders may be other than three without departing from the scope of the present invention. As used herein, the terms "proximal", "distal", and "intermediate" represent relative locations of components, parts and the like of the compression sleeve when the sleeve is secured to the wearer's limb. As such, a "proximal" component or the like is disposed most adjacent to a point of attachment of the wearer's limb to the wearer's torso, a "distal" component is disposed most distant from the point of attachment, and an "intermediate" component is disposed generally anywhere between the proximal and distal components.

The bladders 28*a*, 28*b*, 28*c* are circumferential bladders meaning that they are sized and shaped to wrap around the wearer's limb or around very nearly the entire circumference of the limb. For example, in one embodiment, the bladders 28*a*, 28*b*, 28*c* each extend around at least 90% around a leg. It is to be understood that the construction described herein can be adopted by the prior art sleeves with a partial bladder construction, without departing from the scope of the present invention.

The intermediate layers 18, 20 may be secured together by radiofrequency (RF) welding, adhesive, or other chemical and/or mechanical process. Further, the intermediate layers 18, 20 may be secured together at other locations, such as around their peripheries or at the bladder seam lines 26 to further define the shape of the inflatable bladders 28*a*, 28*b*, 28*c*. The first intermediate layer 18 may be secured to the inner layer 16 along a seam line 46 extending along the outer periphery of the first intermediate layer 18 so central regions of the bladders 28*a*, 28*b*, 28*c* are not secured to the inner layer 16 permitting the bladders to move relative to the inner layer 16. The second intermediate layer 20 may also be secured to the inner layer 12 along the same seam line 46. The first intermediate layer 18 may be secured to the inner layer 16 by RF welding, adhesive, or in other suitable ways.

Referring to FIG. 4, each inflatable bladder 28*a*, 28*b*, 28*c* receives fluid from the controller 14 mounted on the sleeve 12 via a dedicated proximal bladder tube 34*a*, intermediate bladder tube 34*b*, and distal bladder tube 34*c*, respectively, fluidly connecting the bladders to the controller. As will be appreciated, a tube line need not be dedicated to a bladder to practice the invention. In one embodiment, the bladders 28*a*, 28*b*, 28*c* are configured to hold air pressurized in a range of about 10 mm Hg (1333 Pa) to about 45 mm Hg (6000 Pa). Further, the bladders 28*a*, 28*b*, 28*c* are preferably capable of being repeatedly pressurized without failure. Materials suitable for the sheets include, but are not limited to, flexible PVC material that will not stretch substantially. In another embodiment, the intermediate layers 18, 20 may form a chamber for receiving an inflatable bladder that is formed separate from the chamber. In this embodiment, the layers 18, 20 need not be capable of containing pressurized air provided the inflatable bladders are. As will be appreciated by those skilled in the art, the bladders 28*a*, 28*b*, 28*c* may have openings 36 extending completely through the bladders. Further, these opening 36 may be formed by a seam line 30 sealing the bladder layers 18, 20 together. In the illustrated embodiment, the openings 36 are tear-drop-shaped, but the openings may have other shapes without departing from the scope of the invention.

The inner layer 16 may be constructed of a material that is capable of wicking moisture. The inner (or "wicking") layer 16, through capillary action, absorbs moisture trapped near the limb of the wearer, carries the moisture away from the surface of the limb, and transports the moisture from locations on the limb at the inner layer 16 where the moisture is abundant to areas where it is less abundant (e.g., closer to the openings 36 in the bladders 28*a*, 28*b*, 28*c*), to evaporate to the ambient environment. The openings 36 may have various sizes, shapes, and locations within the area of the bladder providing the compression. Each opening 36 may expose the wicking layer 16 to the ambient air as opposed to the portion of the wicking layer beneath the bladder material. The portions of the inner layer 16 in registration with the openings 36 may be referred to as "exposed portions". Other ways of exposing the wicking material such as slits or extending the wicking material outside the perimeter of the bladder material are also envisioned as being within the scope of the present invention. If the sleeve 12 is constructed having only two bladder layers 18, 20, then the openings 36 expose portions of the limb of the wearer to the atmosphere.

In the illustrated embodiment, the bladders 28*a*, 28*b*, 28*c* have openings 36. Thus, the regions of the sleeve 12 that expand and contract under the influence of air pressure or other fluids to provide compression have the openings 36. The regions of the sleeve 12 that do not provide compression (e.g., the seam lines 26) do not have openings 36. The wicking material 16 may be inter-weaved with the impervious material to form the inner layer 16 that transports moisture to an area of less moisture. The openings 36 must be sized, shaped, and positioned so the sleeve provides adequate compression to maintain blood velocity, while maximizing evaporation of moisture. Suitable wicking materials may comprise, for example, some forms of polyester and/or polypropylene. Microfibers may be used. Suitable microfiber materials include, but are not limited to, CoolDry model number CD9604, sold by Quanzhou Fulian Warp Knitting Industrial Co., Ltd. of Quanzhou City, Fujian Province, China, and CoolMax®, sold by E. I. duPont de Nemours and Company of Wilmington, Del.

Figure 5:
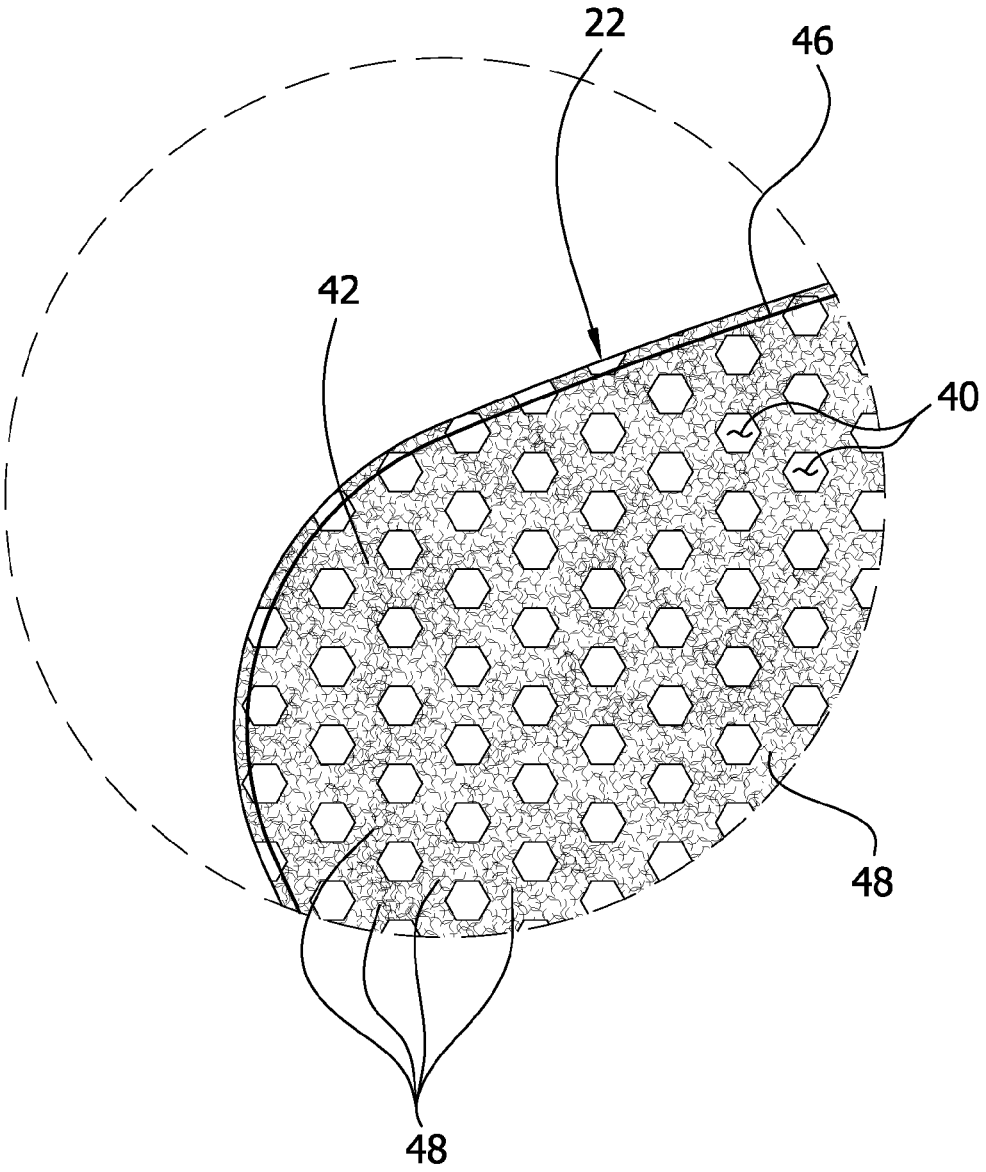
FIG. 5 is an enlarged fragmentary elevation of the outer cover illustrating loop material.
Figure 6:
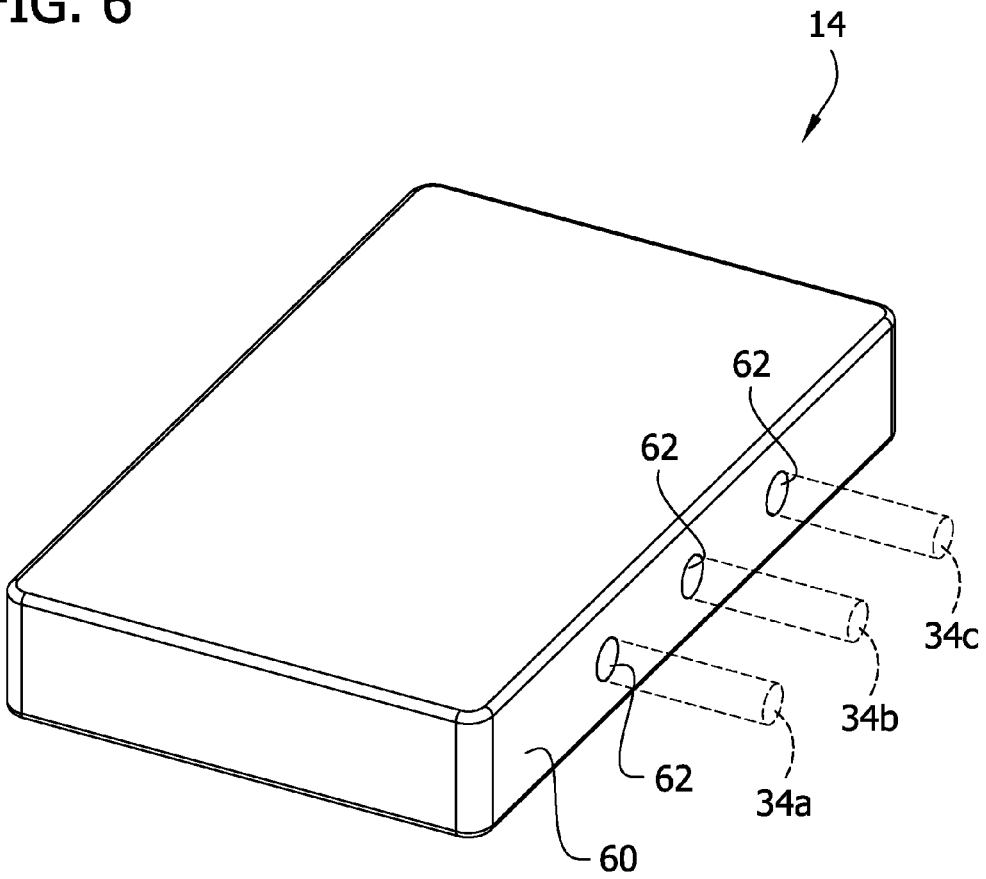
FIG. 6 is a perspective view of a controller of the compression device.
Figure 7:
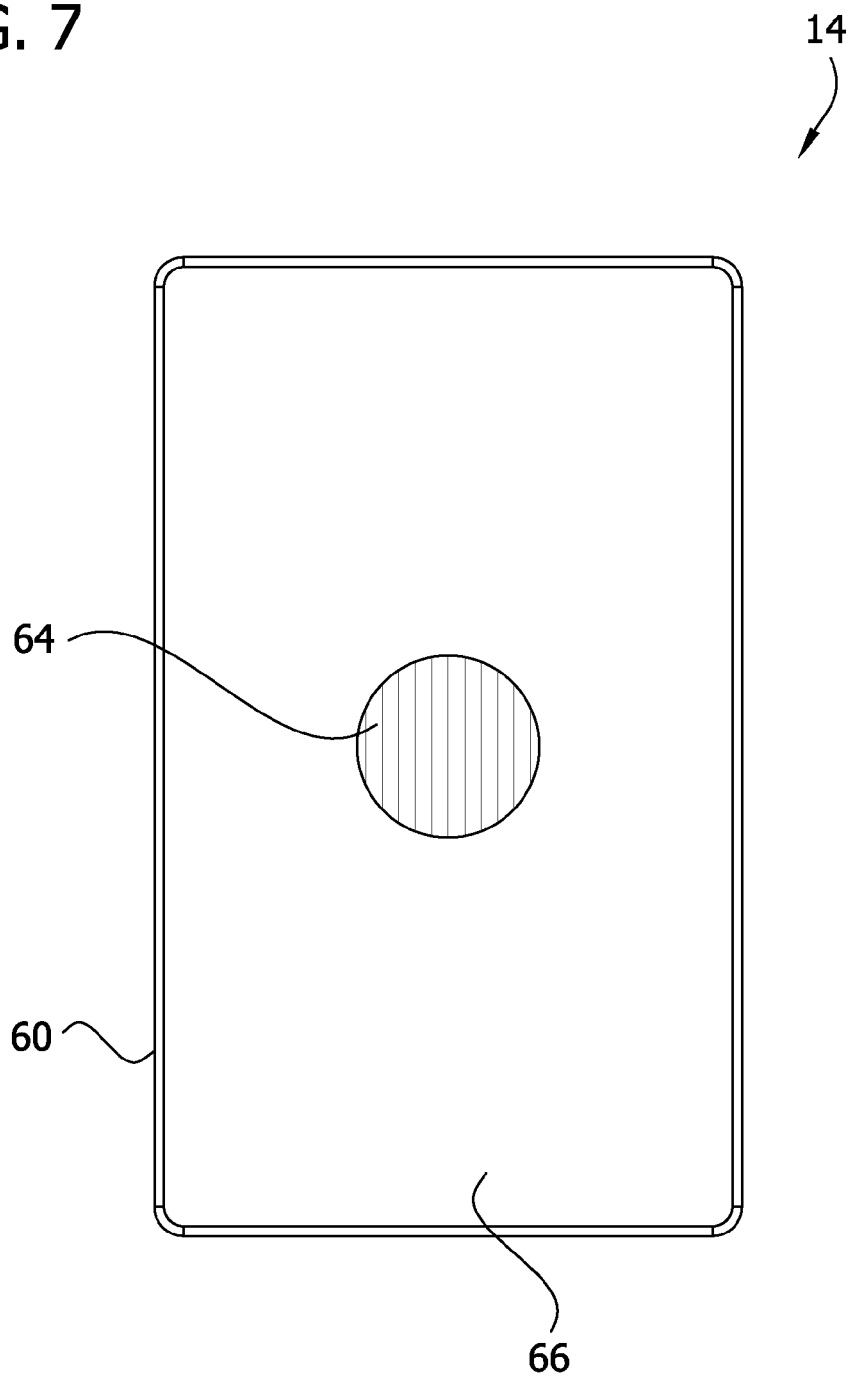
FIG. 7 is a rear view of the controller.

Referring to FIGS. 4 and 5, the outer cover 22 of the compression sleeve 12 may be constructed of a single sheet of material. In the embodiment, the outer cover 22 is breathable and has a multiplicity of openings 40 or perforations so it has a mesh construction to provide even more breathability. A suitable material for the outer cover 22 may be a polyester mesh. The rate of evaporation through the openings is improved by treating the fibers of the mesh material with a hydrophilic material, so the mesh material absorbs the wicked fluid more readily. Wicking fibers of this type are indicated generally by 42 in FIG. 5. These hydrophilic fibers 42 lower the surface tension of the mesh material to allow bodily fluids to more easily absorb into the fibers and spread through the material to provide more efficient evaporation of the wicked fluid. Absorbing fluid more readily allows the fluid to move to the open areas more quickly for evaporation. The capillary effect is made more efficient when the absorbed fluid from the openings moves more quickly through the mesh outer cover 22.

The entire outer surface of the outer cover 22 may act as a fastening component of a fastening system for securing the sleeve 12 to the limb of the wearer. In a particular embodiment, the outer cover 22 of mesh (FIG. 5) has an outer surface comprising loops 48, that act as a loop component of a hook-and-loop fastening system. A mesh construction, as shown in FIG. 5, may have interconnected or weaved fibers 42 of material forming the outer cover 22. The loops 48 may be formed as part of the material of the outer cover 22 or otherwise disposed on the surface of the outer cover. A suitable material with such construction is a polyester mesh loop 2103 sold by Quanzhou Fulian Warp Knitting Industrial Co., Ltd. of Quanzhou City, China. Hook components (not shown) may be attached to an inner surface of the inner layer 16 at proximal, intermediate and distal flaps 50*a*, 50*b*, 50*c*, respectively (FIG. 4). The loops 48 of the outer cover 22 allow the hook components to be secured anywhere along the outer surface of the outer cover 22 when the sleeve 12 is wrapped circumferentially around the limb of the wearer. This allows the sleeve 12 to be of a substantially one-size-fits-all configuration with respect to the circumferences of different wearers' limbs. Moreover, the loops 48 on the outer cover 22 allow the practitioner to quickly and confidently secure the sleeve 12 to the wearer's limb without needing to align the fastening components.

It is contemplated that the outer cover 22 may be capable of wicking fluid in addition to being breathable. For example, the outer cover 22 may be constructed of the same material as the inner layer 16 (e.g., Cool dry). In this way, the moisture wicked by the inner layer 16 may be wicked by the outer cover 22 through the openings 36 in the bladders 28*a*, 28*b*, 28*c*. The moisture can spread out evenly across the outer cover 22 and is able to evaporate more readily than if the outer cover was not formed of a wicking material because a greater surface area of the outer cover, as opposed to the inner layer 16, is exposed to air. Alternatively, the cover 22 can have a wicking material laced in or on top of outer layer.

Referring to FIGS. 6-9, the controller 14 comprises a housing 60 enclosing the necessary components for pressurizing the bladders 28*a*, 28*b*, 28*c*. The controller 14 may be programmed to execute various compression regimens, which may include inflation and deflation (vent) phases. A configuration in which a controller 14 is removably mounted on a compression garment and operatively connected to bladders on the compression garment is disclosed in more detail in U.S. patent applications Ser. Nos. 12/241,670, 12/241,936, and 12/893,679 which are assigned to Tyco Healthcare Group LP and incorporated by reference in their entireties. Other embodiments where the controller 14 is not configured for mounting directly on the sleeve 12 are also within the scope of the present invention.

Supply ports 62 in the controller housing 60 are configured to attach the bladder tubes 34*a-c* to the controller 14 for delivering pressurized fluid to the inflatable bladders 28*a-c*. An exhaust port 64 (FIG. 7) is disposed in a back 66 of the controller housing 60 for expelling the vented pressurized fluid from the compression device 10 during the vent phase. In the illustrated embodiment, a single exhaust port 64 is shown. However, the controller 14 may also have a plurality of exhaust ports without departing from the scope of the invention.

Figure 8:
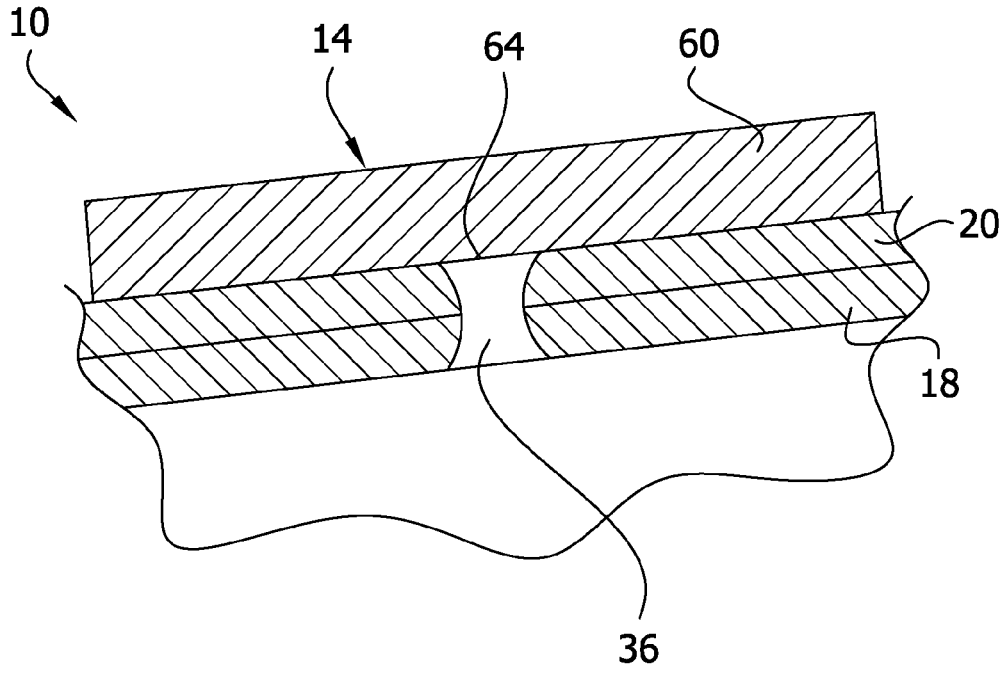
FIG. 8 is an enlarged fragmentary section showing an exhaust port in the controller in registration with an opening in the sleeve.
Figure 8A:
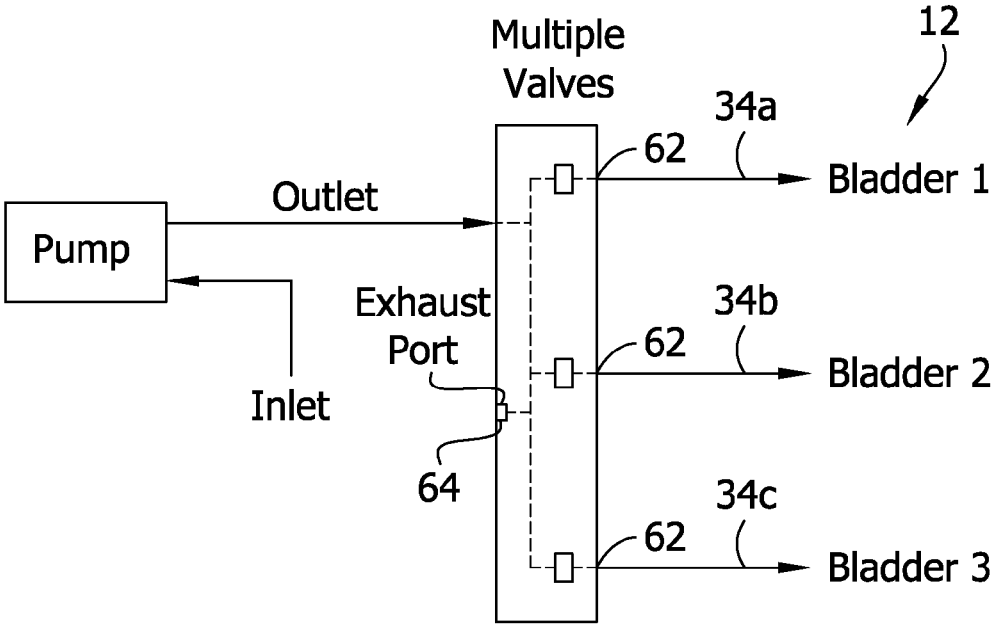
FIG. 8A is a schematic representation of the compression device of FIGS. 3-7.
Figure 9:
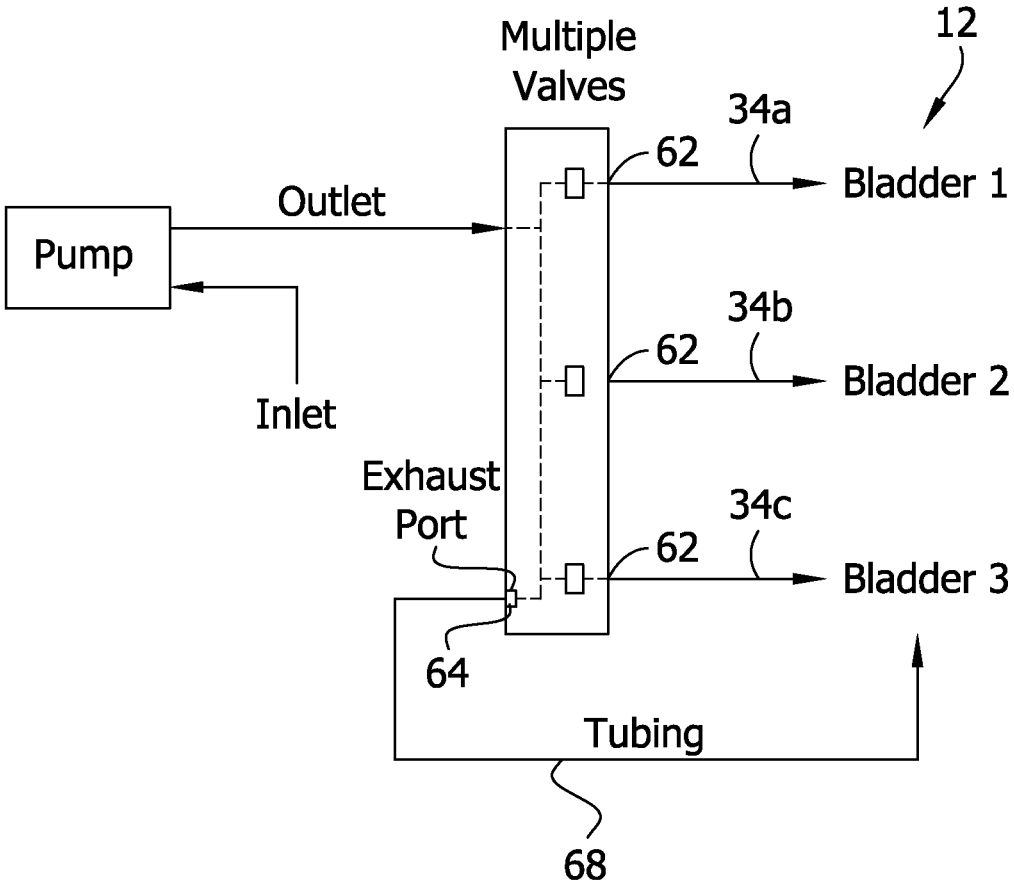
FIG. 9 is a schematic of a second embodiment of a compression device of the present invention.

Referring to FIGS. 3 and 8, the controller 14 is mounted on the sleeve 12 such that the exhaust port 64 faces an outer surface of the sleeve (e.g., outer cover 22 or second intermediate layer 20). Therefore, during the vent phase, the exhausted fluid is not expelled into ambient as is the case with prior art designs. Instead, the vented fluid is directed onto the sleeve 12. The vented air will flow past the outer cover, bladder layers and inner layer, and flow over the leg of the wearer providing a cooling effect to the leg and improving moisture evaporation, because the outer cover 22 is formed of a mesh material, because the bladder layers 18, 20 have openings 36, and because the inner layer 16 is gas permeable. In the illustrated embodiment, the exhaust port 64 is located in a calf area of the leg. Typically, the calf area is the location where a larger percentage of moisture accumulates during compression treatment. The exhaust port 64 could be located in a different area of the leg without departing from the scope of the present invention.

Referring to FIG. 8, the exhaust port 64 may be positioned directly over an opening 36 in the bladder layers 18, 20 to increase the amount of air that impinges upon the leg. When the controller 14 includes multiple exhaust ports 64, they can be generally aligned with an opening 36. If the compression device is configured so that the controller is not mounted directly on the sleeve, an exhaust port of the controller can be in fluid communication with an exterior surface of the sleeve through tubing 68 (FIG. 9) extending from the exhaust port 64 to the sleeve 12. The tubing can be positioned such that the vented air is directed through an opening 36 in the bladder layers 18, 20 (FIG. 4).

Figure 10:
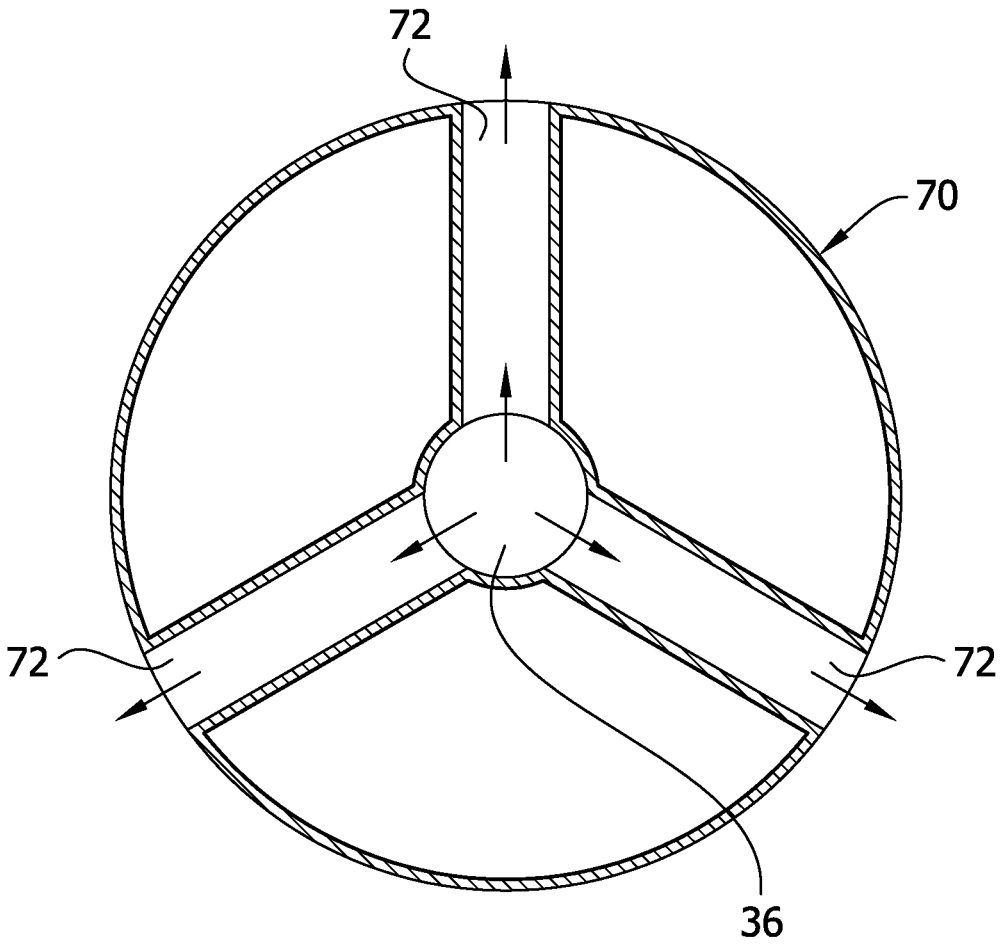
FIG. 10 is an enlarged fragmentary elevation of an inner surface of a first intermediate layer of the compression sleeve.

Referring to FIG. 10, fluid impermeable sheets 70 (e.g., plastic sheets) can be welded (e.g., by RF welding) around the openings 36 that receive the vented fluid. In FIG. 10 the opening 36 is circular, but can also be teardrop-shaped as shown in FIGS. 3 and 4. The sheets 70 can be welded to an inner surface of the first intermediate layer 18 and around the opening 36 as shown to form three fluid channels 72 for directing fluid entering the opening 36 away from the opening. The channels 72 guide the air to facilitate the cooling of areas of the wearer's skin that are not directly below the opening 36. For example, it is envisioned that the channels 70 can be formed to guide air toward a back of the wear's calf where more perspiration may be present. Although the sheet 70 is welded to form three channels 72 in the illustrated embodiment, those skilled in the art will appreciate that fewer or more channels may be formed or the sheets may be embossed with dimples to provide multiple airways. As will also be appreciated, the sheet-and-channel configuration may be broadly referred to as a guide.

Having described the invention in detail, it will be apparent that modifications and variations are possible without departing from the scope of the invention defined in the appended claims.

When introducing elements of the present invention or the preferred embodiments(s) thereof, the articles "a", "an", "the", and "said" are intended to mean that there are one or more of the elements. The terms "comprising", "including", and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A compression device for providing compression treatment to a limb of a wearer, the device comprising:

a compression garment positionable on the limb of the wearer, the garment comprising an inflatable bladder for providing compression treatment to a compression region of the limb; and a controller fluidly connected to the inflatable bladder and configured for inflating and deflating the bladder during a compression cycle, the controller including an exhaust port positioned to direct exhaust fluid toward the compression region as the bladder deflates so exhaust fluid flows over the limb of the wearer to cool the limb, wherein the controller is portable and attachable directly to the compression garment, the exhaust port directly opposing an outer surface of the compression garment when the controller is attached to the compression garment.

2. A compression device as set forth in claim 1 wherein:

the compression garment has an opening; and the exhaust port is positioned to direct the exhaust fluid through the opening in the garment.

3. A compression device as set forth in claim 2 further comprising a guide attached to the bladder around the opening for guiding fluid directed to the opening to flow over the limb of the wearer.

4. A compression device as set forth in claim 3 wherein the guide includes channels extending radially outward from the opening.

5. A compression device as set forth in claim 1 wherein the controller comprises a plurality of exhaust ports in the controller.

6. A compression device as set forth in claim 1 wherein the compression garment further comprises an inner wicking layer for contacting the limb of the wearer to wick fluid away from the wearer.

7. A compression device as set forth in claim 6 wherein the compression garment further comprises a mesh outer cover.

8. A method of providing compression treatment to a limb of a wearer using a compression device including an inflatable bladder positioned on the limb of the wearer and a controller fluidly connected to the inflatable bladder, the method comprising:

pressurizing the inflatable bladder with pressurized fluid from the controller to inflate the bladder and compress a compression region of the limb;

depressurizing the inflatable bladder by venting the pressurized fluid out of the inflatable bladder;

exhausting the vented fluid out of the controller through an exhaust port in the controller; and directing the vented fluid toward the compression region of the limb to cool the limb, wherein the controller is portable and attachable directly to the compression garment, the exhaust port directly opposing an outer surface of the compression garment when the controller is attached to the compression garment.

9. A compression device for providing compression treatment to a limb of a wearer, the device comprising:

a compression garment positionable on the limb of the wearer, the garment comprising an inflatable bladder for providing compression treatment to a compression region of the limb, the garment having an opening;

a controller fluidly connected to the inflatable bladder and configured for inflating and deflating the bladder during a compression cycle, the controller including an exhaust port positioned to direct exhaust fluid through the opening in the garment and to direct the exhaust fluid toward the compression region as the bladder deflates so exhaust fluid flows over the limb of the wearer to cool the limb; and a guide attached to the bladder around the opening for guiding fluid directed to the opening to flow over the limb of the wearer.

10. A compression device as set forth in claim 9 wherein the guide includes channels extending radially outward from the opening.

11. A compression device as set forth in claim 9 wherein:

the compression garment has a plurality of openings including said opening; and the controller has a plurality of exhaust ports including said port configured to direct exhaust fluid through the plurality of openings in the garment when the controller is attached to the garment.

12. A compression device as set forth in claim 9 further comprising tubing positioned to direct exhaust fluid to the opening in the garment.

13. A compression device as set forth in claim 9 wherein the compression garment further comprises an inner wicking layer for contacting the limb of the wearer to wick fluid away from the wearer.

14. A compression device as set forth in claim 13 wherein the compression garment further comprises a mesh outer cover.

* * * * *